US011045872B2

(12) United States Patent
Ishii et al.

(10) Patent No.: US 11,045,872 B2
(45) Date of Patent: Jun. 29, 2021

(54) ALLOY POWDER, SINTERED MATERIAL, METHOD FOR PRODUCING ALLOY POWDER, AND METHOD FOR PRODUCING SINTERED MATERIAL

(71) Applicant: Sumitomo Electric Industries, Ltd., Osaka (JP)

(72) Inventors: Akito Ishii, Itami (JP); Takashi Harada, Itami (JP); Katsumi Okamura, Itami (JP); Satoru Kukino, Itami (JP)

(73) Assignee: Sumitomo Electric Industries, Ltd., Osaka (JP)

( * ) Notice: Subject to any disclaimer, the term of this patent is extended or adjusted under 35 U.S.C. 154(b) by 186 days.

(21) Appl. No.: 16/096,761

(22) PCT Filed: Apr. 19, 2017

(86) PCT No.: PCT/JP2017/015727

§ 371 (c)(1),
(2) Date: Oct. 26, 2018

(87) PCT Pub. No.: WO2017/188088

PCT Pub. Date: Nov. 2, 2017

(65) Prior Publication Data

US 2019/0118256 A1 Apr. 25, 2019

(30) Foreign Application Priority Data

Apr. 28, 2016 (JP) ..... JP2016-091335

(51) Int. Cl.
*B22F 1/00* (2006.01)
*B22F 3/14* (2006.01)
(Continued)

(52) U.S. Cl.
CPC ..... *B22F 1/0011* (2013.01); *B22F 1/0081* (2013.01); *B22F 1/0085* (2013.01);
(Continued)

(58) Field of Classification Search
CPC .... B22F 1/0003; B22F 1/0007; B22F 1/0011; B22F 1/0014; B22F 1/0018; B22F 1/0022;
(Continued)

(56) References Cited

U.S. PATENT DOCUMENTS 3,649,378 A 3/1972 Kotval
3,715,791 A * 2/1973 Berghezan ..... C22C 49/08 75/229
(Continued)

FOREIGN PATENT DOCUMENTS

GB 1247356 A * 9/1971 ..... C22C 32/0026
JP S47-042507 A 12/1972
(Continued)

*Primary Examiner* — Vanessa T. Luk
(74) *Attorney, Agent, or Firm* — Baker Botts L.L.P.; Michael A. Sartori

(57) ABSTRACT

An alloy powder contains greater than or equal to 3% by mass and less than or equal to 30% by mass of tungsten, greater than or equal to 2% by mass and less than or equal to 30% by mass of aluminum, greater than or equal to 0.2% by mass and less than or equal to 15% by mass of oxygen, and at least one of cobalt and nickel as the balance. The alloy powder has an average particle diameter of greater than or equal to 0.1 μm and less than or equal to 10 μm.

11 Claims, 2 Drawing Sheets

(51) Int. Cl.

| | |
|---|---|
| ***C22C 1/04*** | (2006.01) |
| ***C22C 32/00*** | (2006.01) |
| ***C22C 1/10*** | (2006.01) |
| ***C22C 19/07*** | (2006.01) |
| ***C22C 19/03*** | (2006.01) |
| ***B22F 9/04*** | (2006.01) |
| ***B22F 9/14*** | (2006.01) |
| ***C22C 30/00*** | (2006.01) |
| *C22C 27/04* | (2006.01) |

(52) U.S. Cl.
CPC ..... *B22F 3/14* (2013.01); *B22F 9/04* (2013.01); *B22F 9/14* (2013.01); *C22C 1/0433* (2013.01); *C22C 1/1031* (2013.01); *C22C 1/1084* (2013.01); *C22C 19/03* (2013.01); *C22C 19/07* (2013.01); *C22C 30/00* (2013.01); *C22C 32/0026* (2013.01); *B22F 2201/02* (2013.01); *B22F 2202/13* (2013.01); *B22F 2301/15* (2013.01); *B22F 2302/253* (2013.01); *B22F 2998/10* (2013.01); *C22C 27/04* (2013.01)

(58) Field of Classification Search
CPC ..... B22F 1/0025; B22F 1/004; B22F 1/0044; B22F 1/0048; B22F 1/0051; B22F 1/0055; B22F 2001/0029; B22F 2001/0033; B22F 2001/0037; B22F 2201/03; B22F 2301/15; B22F 2301/155; B22F 2302/25; B22F 2302/253; B22F 2302/256; B22F 2304/054; B22F 2304/056; B22F 2304/058; B22F 2304/10; C22C 1/023; C22C 1/0433; C22C 1/0441; C22C 30/00; C22C 32/0026
See application file for complete search history.

(56) References Cited

U.S. PATENT DOCUMENTS

| | | | | |
|---|---|---|---|---|
| 4,668,312 | A * | 5/1987 | Benn | C22C 32/0026 148/410 |
| 2011/0142711 | A1 | 6/2011 | Ukai et al. | |

FOREIGN PATENT DOCUMENTS

| | | | |
|---|---|---|---|
| JP | S49-049824 | A | 5/1974 |
| JP | S49-032405 | B | 8/1974 |
| JP | S50-016731 | B | 6/1975 |
| JP | S50-104110 | A | 8/1975 |
| JP | S62-050434 | A | 3/1987 |
| JP | 04-080302 | A | 3/1992 |
| JP | 04-107202 | A | 4/1992 |
| JP | H07-090438 | A | 4/1995 |
| WO | 2010-021314 | A1 | 2/2010 |

* cited by examiner

ALLOY POWDER, SINTERED MATERIAL, METHOD FOR PRODUCING ALLOY POWDER, AND METHOD FOR PRODUCING SINTERED MATERIAL

TECHNICAL FIELD

The present disclosure relates to an alloy powder, a sintered material, a method for producing an alloy powder, and a method for producing a sintered material. The present application claims priority based on Japanese Patent Application No. 2016-091335 filed Apr. 28, 2016. All descriptions described in the Japanese patent application are incorporated herein by reference.

BACKGROUND ART

In WO 2010/021314 (PTL 1), a dispersion-strengthened alloy containing aluminum, hafnium, and yttrium oxide is disclosed.

CITATION LIST

Patent Literatures

PTL 1: WO 2010/021314
PTL 2: Japanese Patent Laying-Open No. 47-42507
PTL 3: Japanese Patent Laying-Open No. 49-49824
PTL 4: Japanese Patent Laying-Open No. 7-90438

SUMMARY OF INVENTION

An alloy powder of the present disclosure contains: greater than or equal to 3% by mass and less than or equal to 30% by mass of tungsten; greater than or equal to 2% by mass and less than or equal to 30% by mass of aluminum; greater than or equal to 0.2% by mass and less than or equal to 15% by mass of oxygen; and at least one of cobalt and nickel as the balance. The alloy powder has an average particle diameter of greater than or equal to 0.1 μm and less than or equal to 10 μm.

DETAILED DESCRIPTION

Figure 1:
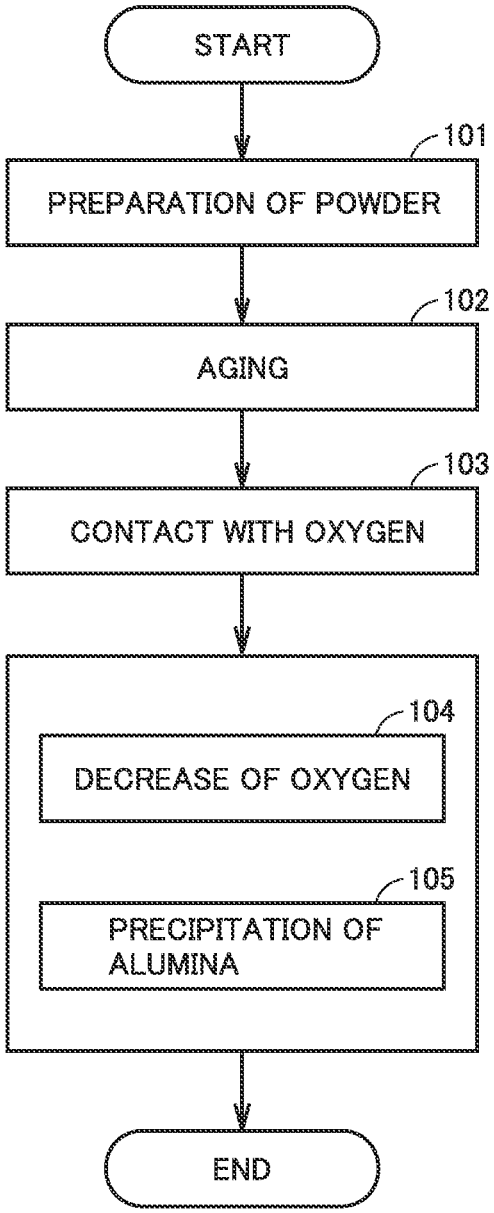
FIG. 1 is a flowchart schematically showing a method for producing an alloy powder according to the present embodiment.

Problem to be Solved by the Present Disclosure

Conventionally, various kinds of heat resistant parts (sintered materials) are produced by molding and sintering alloy powders.

For example, extremely high heat resistance is required for a turbine disk or the like of a jet engine. Nickel (Ni) based alloys and cobalt (Co) based alloys or the like have been developed for such super heat resistant applications.

With oxide fine particles dispersed in a sintered material (alloy), the high temperature hardness of the sintered material is expected to be improved. Such an alloy is referred to as a dispersion-strengthened alloy. Conventionally, yttria ($Y_2O_3$) is known as the oxide fine particles.

As the high temperature hardness of the fine oxide particles to be dispersed is higher, or the oxide fine particles to be dispersed are finer, the dispersion strengthening is expected to be improved. Therefore, it is conceivable to use alumina ($Al_2O_3$) as the oxide fine particles. This is because alumina has higher high temperature hardness than yttria.

However, in the dispersion strengthened alloy containing alumina, the grain growth of alumina tends to progress during heating. The coarsening of alumina caused by the grain growth causes reduced dispersion strengthening in the sintered material.

An object of the present disclosure is to provide an alloy powder that can provide a sintered material having improved high temperature hardness.

Advantageous Effect of the Present Disclosure

The present disclosure can provide an alloy powder that can provide a sintered material having improved high temperature hardness.

DESCRIPTION OF EMBODIMENTS

Initially, embodiments of the present disclosure will be listed and described.

[1] An alloy powder of the present disclosure contains: greater than or equal to 3% by mass and less than or equal to 30% by mass of tungsten (W); greater than or equal to 2% by mass and less than or equal to 30% by mass of aluminum (Al); greater than or equal to 0.2% by mass and less than or equal to 15% by mass of oxygen (O); and at least one of cobalt (Co) and nickel (Ni) as the balance. The alloy powder has an average particle diameter of greater than or equal to 0.1 μm and less than or equal to 10 μm.

The alloy powder contains a larger amount of oxygen than an ordinary alloy powder. That is, the alloy powder contains greater than or equal to 0.2% by mass and less than or equal to 15% by mass of oxygen. When the oxygen content is greater than or equal to 0.2% by mass, fine alumina is precipitated during sintering. The fine alumina provides dispersion strengthening. As a result, a sintered material having improved high temperature hardness is provided. However, when the oxygen content is greater than 15% by mass, the precipitation amount of alumina becomes excessive. This may cause deteriorated toughness of the sintered material.

"Oxygen content" herein is measured by an inert gas melting-non dispersive infrared absorption method. For the measurement, for example, an oxygen/nitrogen analyzer "EMGA-920" manufactured by HORIBA, Ltd. or the like, or its similar product is used. For one alloy powder, the measurement is carried out at least five times. The arithmetic average value of at least five measurement results is adopted as the oxygen content.

Furthermore, the alloy powder has an average particle diameter of greater than or equal to 0.1 μm and less than or equal to 10 μm. When the average particle diameter is less than or equal to 10 μm, the alloy powder can contain greater than or equal to 0.2% by mass of oxygen. This is because the surface area of the alloy powder becomes moderately large. When the average particle diameter is less than 0.1 μm, the oxygen content may be greater than 15% by mass. Thus, the precipitation amount of alumina is also excessive, which may cause reduced toughness of the sintered material.

"Average particle diameter" herein indicates a particle diameter of a total of 50% from a fine particle side in volume-based particle diameter distribution. The average particle diameter is measured by a laser diffraction/scattering method. For one alloy powder, the measurement is carried out at least five times. The arithmetic average value of at least five measurement results is adopted as the average particle diameter. Hereinafter, the average particle diameter is also described as "d50".

The alloy powder contains greater than or equal to 3% by mass and less than or equal to 30% by mass of W. The solid solubility limit of W in this alloy is 30% by mass. That is, when the W content is greater than 30% by mass, W may be precipitated. If W is precipitated, the mechanical properties of the sintered material may be deteriorated. If the W content is less than 3% by mass, an alloy exhibiting desired high temperature hardness may not be formed.

The alloy powder contains greater than or equal to 2% by mass and less than or equal to 30% by mass of Al. The solid solubility limit of Al in this alloy is 30% by mass. That is, if the Al content is greater than 30% by mass, Al may be precipitated. If Al is precipitated, the mechanical properties of the sintered material may be deteriorated. If the Al content is less than 2% by mass, an alloy exhibiting desired high temperature hardness may not be formed.

Herein, when there are figures below the decimal point in the measured value and its arithmetic average value, the significant figure is limited to two decimal places. The third decimal place is rounded off.

"Content of each metal element" herein is measured by an inductively coupled plasma mass spectrometer (ICP-MS). For the measurement, for example, ICP-MS "ICPMS-2030" manufactured by Shimadzu Corporation, or the like, or its similar product is used. For one alloy powder, the measurement is carried out at least five times. The arithmetic mean value of at least five measurement results is adopted as the content of each metal element.

[2] The alloy powder may contain greater than or equal to 3% by mass and less than or equal to 15% by mass of the oxygen. The alloy powder may have an average particle diameter of greater than or equal to 0.1 μm and less than or equal to 4 μm. This is because toughness and abrasion resistance are expected to be improved.

[3] The alloy powder may contain greater than or equal to 4% by mass and less than or equal to 10% by mass of the oxygen. The alloy powder may have an average particle diameter of greater than or equal to 0.3 μm and less than or equal to 2 μm. This is because toughness and abrasion resistance are expected to be improved.

[4] The alloy powder may contain greater than or equal to 5% by mass and less than or equal to 8% by mass of the oxygen. The alloy powder may have an average particle diameter of greater than or equal to 0.5 μm and less than or equal to 1.5 μm.

This is because toughness and abrasion resistance are expected to be improved.

[5] The alloy powder may contain greater than or equal to 5% by mass and less than or equal to 25% by mass of the tungsten. This is because high temperature hardness and mechanical properties are expected to be improved. [6] The alloy powder may contain greater than or equal to 5% by mass and less than or equal to 15% by mass of the aluminum. This is because high temperature hardness and mechanical properties are expected to be improved.

[7] The alloy powder may further contain at least one selected from the group consisting of a transition metal (excluding the tungsten, the cobalt, and the nickel), silicon, germanium, boron, carbon, and tin as the balance.

With the metal powder further containing the balance selected from these elements, the deflective strength of the sintered material is expected to be improved. The "transition metal" represents any of elements of Groups 3 to 11 of the periodic table.

[8] An alloy powder contains: greater than or equal to 5% by mass and less than or equal to 25% by mass of tungsten; greater than or equal to 5% by mass and less than or equal to 15% by mass of aluminum; greater than or equal to 5% by mass and less than or equal to 8% by mass of oxygen; greater than or equal to 35% by mass and less than or equal to 45% by mass of nickel; and cobalt as the balance. The alloy powder has an average particle diameter of greater than or equal to 0.5 μm and less than or equal to 1.5 μm.

This alloy powder can provide a sintered material having improved high temperature hardness, toughness, wear resistance, and mechanical properties.

[9] At least part of the oxygen may be adsorbed to the alloy powder.

Hereinafter, oxygen adsorbed to the alloy powder is also referred to as "adsorbed oxygen". The presence of the oxygen as the adsorbed oxygen may increase the fineness of alumina during sintering. Thus, high temperature hardness is expected to be improved.

[10] At least part of the oxygen and the aluminum may form alumina.

Dispersion strengthening is expected to be improved by dispersing fine alumina in the alloy powder.

Among the oxygen contained in the alloy powder, the proportion of adsorbed oxygen (unit: % by mass) and the proportion of oxygen forming alumina (unit: % by mass) are determined by X-ray diffraction (XRD) analysis and Rietveld analysis. As the XRD apparatus, for example, an XRD apparatus "MiniFlex 600" manufactured by Rigaku Corporation, or the like, or its similar product is used. For the Rietveld analysis, integrated powder X-ray analysis software "PDXL", or the like, or its similar product is used.

[11] The sintered material contains the alloy powder of any one of [1] to [10].

This sintered material is expected to exhibit excellent high temperature hardness provided by dispersion strengthening of fine alumina.

[12] A method for producing an alloy powder includes steps of: preparing an alloy powder containing at least one of cobalt and nickel, tungsten, and aluminum; and bringing the alloy powder into contact with oxygen. The alloy powder contains: greater than or equal to 3% by mass and less than or equal to 30% by mass of the tungsten; greater than or equal to 2% by mass and less than or equal to 30% by mass of the aluminum; greater than or equal to 0.2% by mass and less than or equal to 15% by mass of the oxygen; and at least one of the cobalt and the nickel as the balance; and the alloy powder is produced so that the alloy powder has an average particle diameter of greater than or equal to 0.1 μm and less than or equal to 10 μM.

The alloy powders of the above [1] to [10] can be produced by this producing method.

[13] The step of bringing the alloy powder into contact with the oxygen may include a step of milling the alloy powder in the atmosphere.

This is because the alloy powder can efficiently contact with the oxygen by milling in the atmosphere.

[14] The method for producing an alloy powder may further include a step of decreasing the oxygen contained in the alloy powder. This is because the oxygen content of the alloy powder is easily adjusted to a desired range.

[15] The step of decreasing the oxygen may include a step of heating the alloy powder to higher than or equal to 800° C. and lower than or equal to 1300° C. in a nitrogen ($N_2$) gas atmosphere.

By heating the alloy powder to higher than or equal to 800° C., the oxygen content of the alloy powder is easily decreased. This is considered to be because the alloy powder is reduced. By heating the alloy powder to lower than or equal to 1300° C., the coarsening of the particles in the alloy powder is suppressed. This is considered to be because the melting of the particles is suppressed.

[16] The step of decreasing the oxygen may include a step of bringing the alloy powder into contact with a thermal plasma. The thermal plasma can be generated by converting a gas containing at least one of argon (Ar) gas and hydrogen ($H_2$) gas into a plasma.

The thermal plasma can decrease the oxygen content of the alloy powder. The thermal plasma has a small effect on the particle diameter of the alloy powder.

[17] The method for producing an alloy powder may further include a step of heating the alloy powder before the milling in the above [13] to promote aging of the alloy powder.

As the aging of the alloy progresses, the high temperature hardness of the alloy may be improved. Furthermore, the alloy powder after aging tends to be atomized by milling. The high temperature hardness of the sintered material is also expected to be improved by atomizing the alloy powder.

[18] The method for producing an alloy powder may further include a step of heating the alloy powder in a vacuum to precipitate alumina.

"Vacuum" herein indicates a state where the pressure is less than or equal to $1\times10^2$ Pa. By heating the alloy powder in a vacuum, fine alumina is precipitated in the alloy powder. By previously precipitating fine alumina in the alloy powder, the dispersion strengthening in the sintered material may also be improved.

[19] A method for producing a sintered material includes steps of: preparing the alloy powder according to any one of [1] to [10]; pressurizing the alloy powder; and heating the alloy powder.

A sintered material having improved high temperature hardness can be produced by this producing method.

[20] In the method for producing a sintered material, the alloy powder may be heated to higher than or equal to 900° C. and lower than or equal to 1700° C. while being pressurized to greater than or equal to 10 MPa and less than or equal to 10 GPa.

The coarsening of precipitated alumina is suppressed by heating (sintering) the alloy powder under high pressure. Thus, the dispersion strengthening is expected to be improved.

DETAILS OF EMBODIMENT OF PRESENT DISCLOSURE

Hereinafter, an embodiment of the present disclosure (also described as "the present embodiment" herein) will be described. However, the following description does not limit the scope of claims.

<Alloy Powder>

An alloy powder according to the present embodiment is sintered in itself, whereby a sintered material having improved high temperature hardness can be provided. The alloy powder may also be a binder for cemented carbide, a cubic boron nitride (CBN) sintered material, a diamond sintered material, a ceramic sintered material or the like, for example.

<<Composition>>

The alloy powder has the following composition.

W: greater than or equal to 3% by mass and less than or equal to 30% by mass

Al: greater than or equal to 2% by mass and less than or equal to 30% by mass

Oxygen: greater than or equal to 0.2% by mass and less than or equal to 15% by mass The balance: at least one of Co and Ni (Oxygen Content)

The alloy powder contains greater than or equal to 0.2% by mass and less than or equal to 15% by mass of oxygen. With the oxygen content greater than or equal to 0.2% by mass, fine alumina is expected to be precipitated in the sintered material. Thus, dispersion strengthening in the sintered material is expected to be improved. When the oxygen content is greater than 15% by mass, the precipitation amount of alumina becomes excessive. This may cause deteriorated toughness of the sintered material.

The alloy powder may contain greater than or equal to 3% by mass and less than or equal to 15% by mass, greater than or equal to 4% by mass and less than or equal to 10% by mass, or greater than or equal to 5% by mass and less than or equal to 8% by mass, of oxygen. Thus, the toughness and wear resistance of the sintered material are expected to be improved.

(Presence Form of Oxygen)

In the alloy powder, oxygen may be present as adsorbed oxygen. The oxygen and Al may form alumina.

All of oxygen contained in the alloy powder may be substantially adsorbed oxygen. All of the oxygen contained in the alloy powder may substantially form alumina. The alloy powder may contain both the adsorbed oxygen and the alumina. That is, at least part of the oxygen may be adsorbed to the alloy powder. At least part of the oxygen and Al may form alumina.

Among oxygen contained in the alloy powder, the proportion of adsorbed oxygen may be, for example, greater than or equal to 0% by mass and less than or equal to 100% by mass, greater than or equal to 10% by mass and less than or equal to 90% by mass, greater than or equal to 30% by mass and less than or equal to 70% by mass, or greater than or equal to 40% by mass and less than or equal to 60% by mass. The presence of the adsorbed oxygen may increase the fineness of alumina during sintering. Thus, high temperature hardness is expected to be improved.

Among the oxygen contained in the alloy powder, the balance excluding the adsorbed oxygen may be alumina. That is, among the oxygen contained in the alloy powder, the proportion of oxygen forming alumina may be, for example, greater than or equal to 0% by mass and less than or equal to 100% by mass, greater than or equal to 10% by mass and less than or equal to 90% by mass, greater than or equal to 30% by mass and less than or equal to 70% by mass, or greater than or equal to 40% by mass and less than or equal to 60% by mass. Dispersion strengthening is expected to be improved by dispersing fine alumina in the alloy powder.

The crystalline form of "alumina" herein is not limited. The alumina can have any crystal form known in the art. The alumina may be, for example, α-alumina, γ-alumina, δ-alumina, θ-alumina or the like.

(W Content)

The alloy powder contains greater than or equal to 3% by mass and less than or equal to 30% by mass of W. The solid solubility limit of W in this alloy is 30% by mass. That is, when the W content is greater than 30% by mass, W may be precipitated. If W is precipitated, the mechanical properties of the sintered material may be deteriorated. If the W content is less than 3% by mass, an alloy exhibiting desired high temperature hardness may not be formed.

The alloy powder may contain greater than or equal to 5% by mass and less than or equal to 25% by mass, greater than or equal to 10% by mass and less than or equal to 25% by mass, or greater than or equal to 15% by mass and less than or equal to 20% by mass, of W. With the W content within these ranges, the high temperature hardness and mechanical properties of the sintered material are expected to be improved.

(Al Content)

The alloy powder contains greater than or equal to 2% by mass and less than or equal to 30% by mass of Al. The solid solubility limit of Al in this alloy is 30% by mass. That is, if the Al content is greater than 30% by mass, Al may be precipitated. If Al is precipitated, the mechanical properties of the sintered material may be deteriorated. If the Al content is less than 2% by mass, an alloy exhibiting desired high temperature hardness may not be formed.

The alloy powder may contain greater than or equal to 5% by mass and less than or equal to 15% by mass, or greater than or equal to 5% by mass and less than or equal to 10% by mass, of Al. With the Al content within these ranges, the high temperature hardness and mechanical properties of the sintered material are expected to be improved.

(Balance)

The alloy powder contains at least one of Co and Ni as the balance excluding W, Al, and oxygen. That is, the alloy powder may contain Co alone as the balance, Ni alone as the balance, or both Co and Ni as the balance.

The alloy powder may be a Co-based alloy powder. The "Co-based" indicates that the Co content is greater than the content of each of the other elements. The alloy powder may be a Ni-based alloy powder. The "Ni-based" indicates that the Ni content is greater than the content of each of the other elements. The alloy powder may be an alloy which is based on Co and Ni. The "based on Co and Ni" indicates that the total of the Co content and Ni content is greater than the content of each of the other elements.

The alloy powder may contain, for example, a total amount of greater than or equal to 25% by mass and less than or equal to 94.8% by mass, greater than or equal to 40% by mass and less than or equal to 80% by mass, or greater than or equal to 50% by mass and less than or equal to 70% by mass, of at least one of Co and Ni.

When the alloy powder contains both Ni and Co, the Ni content may be equal to the Co content. The Ni content may be greater than the Co content. The Ni content may be less than the Co content.

The alloy powder may contain, for example, greater than or equal to 20% by mass and less than or equal to 50% by mass, greater than or equal to 25% by mass and less than or equal to 45% by mass, greater than or equal to 30% by mass and less than or equal to 45% by mass, or greater than or equal to 35% by mass and less than or equal to 45% by mass, of Ni.

The alloy powder may contain, for example, greater than or equal to 5% by mass and less than or equal to 44.8% by mass, greater than or equal to 10% by mass and less than or equal to 37% by mass, greater than or equal to 15% by mass and less than or equal to 35% by mass, or greater than or equal to 20% by mass and less than or equal to 35% by mass, of Co. With the Ni content and the Co content within these ranges, the high temperature hardness of the sintered material is expected to be improved.

The alloy powder may also contain inevitable impurities as the balance. The "inevitable impurities" refer to impurities which are inevitably mixed when an alloy powder is produced. Examples of the inevitable impurities include carbon (C), nitrogen (N), iron (Fe), silicon (Si), and chromium (Cr). The alloy powder contains, for example, greater than 0% by mass and less than 0.2% by mass of the inevitable impurities.

(Other Elements)

The alloy powder may contain other elements as the balance. The "other elements" refer to elements other than W, Al, Co, and Ni, the elements intentionally added to the alloy powder. The alloy powder may further contain at least one selected from the group consisting of a transition metal (excluding W, Co, and Ni), Si, germanium (Ge), boron (B), C, and tin (Sn) as the balance. With the metal powder further containing the balance selected from these elements, the deflective strength of the sintered material is expected to be improved.

The transition metal refers to any of elements of Groups 3 to 11 of the periodic table. More specifically, the transition metal refers to any of: elements of Group 3 of the periodic table such as scandium (Sc) and yttrium (Y); elements of Group 4 of the periodic table such as titanium (Ti), zirconium (Zr), and hafnium (Hf); elements of Group 5 of the periodic table such as vanadium (V), niobium (Nb), and tantalum (Ta); elements of Group 6 of the periodic table such as Cr and molybdenum (Mo); elements of Group 7 of the periodic table such as manganese (Mn), technetium (Tc), and rhenium (Re); elements of Group 8 of the periodic table such as Fe, ruthenium (Ru), and osmium (Os); elements of Group 9 of the periodic table such as rhodium (Rh) and iridium (Ir); elements of Group 10 of the periodic table such as palladium (Pd) and (platinum) Pt; and elements of Group 11 of the periodic table such as copper (Cu), silver (Ag), and gold (Au).

For example, the alloy powder may further contain, as the balance, at least one selected from the group consisting of Cr, Ta, V, Nb, Fe, Ir, Si, B, and C. This is because with the metal powder further containing the balance selected from these elements, the improvement width of the deflective strength of the sintered material tends to be large.

For example, the alloy powder may further contain, as the balance, at least one selected from the group consisting of Cr, Nb, Ir, Si, B, and C. This is because with the metal powder further containing the balance selected from these elements, the improvement width of the deflective strength of the sintered material tends to be large.

For example, the alloy powder may further contain, as the balance, at least one selected from the group consisting of Ir, Si, B, and C. This is because with the metal powder further containing the balance selected from these elements, the improvement width of the deflective strength of the sintered material tends to be large.

The alloy powder may contain, for example, greater than or equal to 0.1% by mass and less than or equal to 20% by mass, greater than or equal to 5% by mass and less than or equal to 15% by mass, or greater than or equal to 10% by mass and less than or equal to 15%, of the other elements.

As described above, the alloy powder of the present embodiment may have, for example, the following composition.

W: greater than or equal to 5% by mass and less than or equal to 25% by mass

Al: greater than or equal to 5% by mass and less than or equal to 15% by mass

Oxygen: greater than or equal to 5% by mass and less than or equal to 8% by mass Ni: greater than or equal to 35% by mass and less than or equal to 45% by mass Balance: Co <<Average Particle Diameter>>

The alloy powder has an average particle diameter (d50) of greater than or equal to 0.1 μm and less than or equal to 10 μm Thus, the alloy powder can contain greater than or equal to 0.2% by mass and less than or equal to 15% by mass of oxygen. The alloy powder may have a d50 of greater than or equal to 0.1 μm and less than or equal to 4 μm, greater than or equal to 0.3 μm and less than or equal to 2 μm, or greater than or equal to 0.5 μm and less than or equal to 1.5 μm. With the d50 within these ranges, toughness and abrasion resistance are expected to be improved.

<Method for Producing Alloy Powder>

Hereinafter, a method for producing an alloy powder according to the present embodiment will be described.

FIG. 1 is a flowchart schematically showing a method for producing an alloy powder according to the present embodiment.

As shown in FIG. 1, a method for producing an alloy powder includes the steps of: preparing a powder (101); and bringing the powder into contact with oxygen (103).

The method for producing an alloy powder may further include the step of aging the powder (102) between the step of preparing the powder (101) and the step of bringing the powder into contact with oxygen (103).

The method for producing an alloy powder may further include the step of decreasing the oxygen (104) after the step of bringing the powder into contact with the oxygen (103).

The method for producing an alloy powder may further include the step of precipitating alumina (105) after the step of bringing the powder into contact with the oxygen (103).

The method for producing an alloy powder may include both the step of decreasing the oxygen (104) and the step of precipitating alumina (105).

<<Preparation of Powder (101)>>

A method for producing an alloy powder includes the step of preparing an alloy powder containing: at least one of Co and Ni; W; and Al. The alloy powder can be prepared by a general atomizing method. For example, the alloy powder is prepared by a water atomizing method, a gas atomizing method, a centrifugal atomizing method or the like.

Herein, the water atomizing method will be described as an example.

First, a molten alloy is produced. A high frequency atmospheric melting furnace is used for producing the molten alloy. Each of metal raw materials (W, Al, Co, and Ni) is supplied to the high frequency atmospheric melting furnace.

The supply amount of each of the metal raw materials is determined so that the alloy powder finally contains greater than or equal to 3% by mass and less than or equal to 30% by mass of W, greater than or equal to 2% by mass and less than or equal to 30% by mass of Al, greater than or equal to 0.2% by mass and less than or equal to 15% by mass of oxygen, and at least one of Co and Ni as the balance. The maximum temperature during producing is, for example, 3000° C.

Next, high pressure water is sprayed onto the molten alloy to powder the molten alloy. Finally, the alloy powder is powdered so that the d50 is set to greater than or equal to 0.1 μm and less than or equal to 10 μm. In the water atomizing method, the d50 of the alloy powder can be adjusted by water pressure. By the water pressure, the oxygen content of the alloy powder can also be adjusted. As the water pressure is higher, the alloy powder is more atomized. As the water pressure is higher, the oxygen content tends to increase.

The water pressure may be, for example, greater than or equal to 50 MPa and less than or equal to 100 MPa, greater than or equal to 55 MPa and less than or equal to 90 MPa, greater than or equal to 60 MPa and less than or equal to 85 MPa, or greater than or equal to 65 MPa and less than or equal to 80 MPa. The d50 can also be adjusted by milling to be described below.

<<Aging (102)>>

The method for producing an alloy powder may include the step of heating the alloy powder to promote the aging of the alloy powder before milling. As the aging of the alloy progresses, the high temperature hardness of the alloy may be improved. Furthermore, the alloy powder after aging tends to be atomized by milling to be described later. The high temperature hardness of the sintered material is also expected to be improved by atomizing the alloy powder.

The heating temperature may be, for example, higher than or equal to 500° C. and lower than or equal to 1300° C., higher than or equal to 700° C. and lower than or equal to 1100° C., or higher than or equal to 800° C. and lower than or equal to 1000° C. The atmosphere during heating may be, for example, a vacuum atmosphere, a nitrogen gas atmosphere, an argon gas atmosphere or the like. The treatment time may be, for example, greater than or equal to 2 hours and less than or equal to 200 hours, greater than or equal to 5 hours and less than or equal to 50 hours, or greater than or equal to 10 hours and less than or equal to 30 hours.

<<Contact with Oxygen (103)>>

The method for producing an alloy powder includes the step of bringing an alloy powder into contact with oxygen. Thus, the oxygen is contained in the alloy powder. The alloy powder may be brought into contact with the oxygen so that the alloy powder contains greater than or equal to 0.2% by mass and less than or equal to 15% by mass of the oxygen. Alternatively, the alloy powder may be brought into contact with the oxygen so that the alloy powder contains greater than 15% by mass of the oxygen. However, in this case, after the step of bringing the alloy powder into contact with the oxygen (102), the oxygen is decreased so that the alloy powder contains greater than or equal to 0.2% by mass and less than or equal to 15% by mass of the oxygen. The step of decreasing the oxygen (104) will be described below.

In the above-described water atomization, the alloy powder may be brought into contact with the oxygen. For example, the alloy powder may be dried in the atmosphere. Thus, the alloy powder may be brought into contact with the oxygen. Alternatively, the alloy powder may be milled in the atmosphere. Thus, the alloy powder may be brought into contact with the oxygen. That is, the step of bringing the alloy powder into contact with the oxygen may include the step of milling the alloy powder in the atmosphere. By milling the alloy powder in the atmosphere, the alloy powder can be efficiently brought into contact with the oxygen. By milling, the d50 of the alloy powder can also be adjusted.

The milling method is not particularly limited. For example, the alloy powder is milled by a dry type jet mill, a wet type jet mill, a dry type ball mill, a wet type ball mill or the like. The "dry type" indicates that no solvent is used during milling. The "wet type" indicates that a solvent is used during milling. The oxygen content in the dry type tends to be greater than that in the wet type.

In the dry type jet mill, a milling gas may be, for example, air or the like. The pressure may be, for example, greater than or equal to 0.5 and less than or equal to 3 MPa or greater than or equal to 1 and less than or equal to 2 MPa. The oxygen content in the Jet mill tends to be greater than that in the ball mill.

In the wet type milling, the solvent may be, for example, acetone, ethanol or the like. In the ball mill, for example, alumina balls, silicon nitride balls, cemented carbide balls or the like are used. The milling time may be, for example, greater than or equal to 0.5 and less than or equal to 200 hours.

<<Decrease of Oxygen (104)>>

The method for producing an alloy powder may further include the step of decreasing oxygen contained in the alloy powder. Herein, the oxygen is decreased so that the alloy powder contains greater than or equal to 0.2% by mass and less than or equal to 15% by mass of the oxygen.

The oxygen contained in the alloy powder is decreased, for example, by the following first treatment, second treatment, and third treatment. Any one of the first treatment, the second treatment, and the third treatment may be carried out. Two or more of the first treatment, the second treatment, and the third treatment may be carried out. Each of the first treatment, the second treatment, and the third treatment may be carried out a plurality of times.

(First Treatment)

In the first treatment, the alloy powder is heated in a substantial oxygen-free atmosphere. Thus, the oxygen content of the alloy powder is decreased. The substantial oxygen-free atmosphere is realized by, for example, a high-purity nitrogen gas flow, a high-purity argon gas flow or the like. Herein, as an example, heating in the high purity nitrogen gas flow will be described.

The heating temperature may be, for example, higher than or equal to 800° C. and lower than or equal to 1300° C. That is, the step of decreasing oxygen may include the step of heating the alloy powder to higher than or equal to 800° C. and lower than or equal to 1300° C. in a nitrogen gas atmosphere.

By heating the alloy powder to higher than or equal to 800° C., the oxygen content of the alloy powder is easily decreased. This is considered to be because the alloy powder is reduced. By heating the alloy powder to lower than or equal to 1300° C., the coarsening of the particles in the alloy powder is suppressed. That is, an increase in d50 caused by heating is suppressed. This is considered to be because the melting of the particles is suppressed. The alloy powder may be heated to higher than or equal to 900° C. and lower than or equal to 1000° C. Thus, the decrease of the oxygen is expected. The coarsening of the particles is also expected to be suppressed.

Any high-purity nitrogen gas generally available may be used. The purity of the nitrogen gas is suitably greater than or equal to grade 3. "Grade 3" indicates a purity of a nitrogen gas concentration of greater than 99.9% by volume. "Grade 2" in which a nitrogen gas concentration is greater than 99.999% by volume may be used. "Grade 1" in which a nitrogen gas concentration is greater than 99.99995% by volume may be used. As the purity of the nitrogen gas is higher, the oxygen is easily decreased. As the high purity nitrogen gas, for example, high purity nitrogen "G3 (grade 3)" manufactured by Taiyo Nippon Sanso Corporation, or the like, or its similar product is used.

Heating is carried out, for example, in a carbon furnace in which a high purity nitrogen gas flows. As the carbon furnace, for example, an ultra-high temperature atmosphere electric furnace (model "MTG-620") manufactured by Motoyama Corporation, or the like, or its similar product is used.

As the treatment time is longer, the oxygen content of the alloy powder tends to be decreased. The treatment time may be, for example, greater than or equal to 1 hour and less than or equal to 12 hours, greater than or equal to 1 hour and less than or equal to 5 hours, or greater than or equal to 1 hour and less than or equal to 3 hours.

The flow rate of the nitrogen gas is appropriately adjusted according to the amount of the alloy powder to be treated, or the like. The flow rate of the nitrogen gas may be, for example, from 1 to 5 L/min (liter/minute).

(Second Treatment)

In the second treatment, the alloy powder is heated in a low oxygen partial pressure atmosphere. Thus, the oxygen content of the alloy powder is decreased. The heating temperature and treatment time of the second treatment may be the same as the heating temperature and treatment time of the first treatment. That is, the second treatment may be carried out in a carbon furnace in which a low oxygen partial pressure nitrogen gas flows.

The "low oxygen partial pressure" herein indicates a state in which an oxygen partial pressure is less than or equal to $1\times10^{-10}$ atm. As the oxygen partial pressure is lower, the oxygen content of the alloy powder tends to be decreased. This is considered to be because the alloy powder is efficiently reduced.

The oxygen partial pressure at room temperature may be, for example, from $1\times10^{-10}$ to $1\times10^{-30}$ atm, from $1\times10^{-20}$ to $1\times10^{-30}$ atm, from $1\times10^{-25}$ to $1\times10^{-30}$ atm, or from $1\times10^{-28}$ to $1\times10^{-30}$ atm. The low oxygen partial pressure atmosphere is formed, for example, by controlling an oxygen partial pressure in a nitrogen gas with an oxygen partial pressure control device. As the oxygen partial pressure control device, for example, an oxygen partial pressure controller (type "SiOC-200" manufactured by STLab Co., Ltd.) or the like, or its similar product is used.

(Third Treatment)

In the third treatment, the alloy powder is brought into contact with a thermal plasma. The thermal plasma reduces the alloy powder and decreases the oxygen content. That is, the step of decreasing the oxygen may include the step of bringing the alloy powder into contact with the thermal plasma. The thermal plasma is suitable because it has a small influence on the particle diameter of the alloy powder. For example, the contact of the alloy powder with the thermal plasma minimally increases the d50.

The thermal plasma is generated, for example, by converting a gas containing at least one of an argon gas and a hydrogen gas into a plasma. Herein, as an example, the use of a mixed gas containing an argon gas and a hydrogen gas will be described.

An alloy powder is placed in a chamber of a thermal plasma generator. The pressure inside the chamber is adjusted, for example, to greater than or equal to 20 kPa and less than or equal to 50 kPa. As the plasma gas, a mixed gas containing an argon gas and a hydrogen gas is used. A high frequency current of greater than or equal to 25 kW and less than or equal to 35 kW is applied. Thus, the thermal plasma is generated in the chamber. The alloy powder is brought into contact with the thermal plasma. Thus, the oxygen content of the alloy powder is decreased.

<<Precipitation of Alumina (105)>>

The method for producing an alloy powder may include the step of heating the alloy powder in a vacuum to precipitate alumina. For example, fine alumina is precipitated in the alloy powder by heating the alloy powder in a vacuum. By previously precipitating the fine alumina in the alloy powder, the dispersion strengthening in the sintered material may be improved.

Typically, the atmosphere during heating is a high vacuum (state of from $1\times10^{-1}$ to $1\times10^{-5}$ Pa). The atmosphere may be a medium vacuum (state of from $1\times10^{2}$ *to* $1\times10^{-1}$ Pa) or an ultrahigh vacuum (state of less than or equal to $1\times10^{-5}$ Pa). The heating temperature may be, for example, higher than or equal to 800° C. and lower than or equal to 1000° C.

<Sintered Material>

Hereinafter, the sintered material according to the present embodiment will be described. The sintered material contains the alloy powder of the present embodiment described above. The high temperature hardness of the sintered material is improved by the dispersion strengthening of fine alumina.

The sintered material can contain, for example, greater than or equal to 0.1% by volume and less than or equal to 100% by volume of the alloy powder. The sintered material may be formed by sintering the alloy powder itself. That is, the sintered material may contain substantially 100% by volume of the alloy powder.

The alloy powder may be a binder for the sintered material. That is, the sintered material may contain hard particles and a binder phase. The binder phase contains an alloy powder. The sintered material may contain, for example, greater than or equal to 50% by volume and less than or equal to 99.9% by volume of the hard particles and greater than or equal to 0.1% by volume and less than or equal to 50% by volume of the alloy powder. The hard particles may be, for example, tungsten carbide (WC) particles, CBN particles, diamond particles, titanium nitride (TiN) particles, or the like. That is, the sintered material may be cemented carbide, a CBN sintered material, a diamond sintered material, a ceramic sintered material or the like.

It is identified by energy dispersive X-ray spectrometry (EDX) that the sintered material is substantially composed only of the alloy powder, or that the binder phase of the sintered material contains the alloy powder.

When the sintered material contains the hard particles and the alloy powder (binder phase), the alloy powder content by volume is measured, for example, by the image analysis of a scanning electron microscope (SEM) image. Prior to SEM observation, the sintered material is mirror polished. The polished surface is observed. The observation magnification is adjusted, for example, according to the size of the hard particles or the like. The observation magnification is, for example, about 30,000 times. The reflected electron image of the polished surface is image-analyzed. For example, the reflected electron image is binarized. Thus, pixels in the reflected electron image are classified into pixels derived from the alloy powder (binder phase) and pixels derived from the hard particles. The total area of the pixels derived from the alloy powder is divided by the area of the whole reflected electron image. Thus, the alloy powder content by volume (percentage) is calculated. For one sintered material, the measurement is carried out at five or more places. The arithmetic average value of the measurement results at five or more places is adopted as the alloy powder content by volume.

The sintered material may be, for example, a heat-resistant part, a wear-resistant part, a wear-resistant tool, a cutting tool or the like. The sintered material is suitable for applications where high temperature hardness is required. The sintered material is suitable for, for example, turbine discs, milling tools for heat-resistant alloys, or the like. When the alloy powder is a binder, the binder phase is less likely to soften at a high temperature, whereby the life of the tool or the like is expected to be improved.

<Method for Producing Sintered Material>

Hereinafter, a method of producing a sintered material according to the present embodiment will be described.

Figure 2:
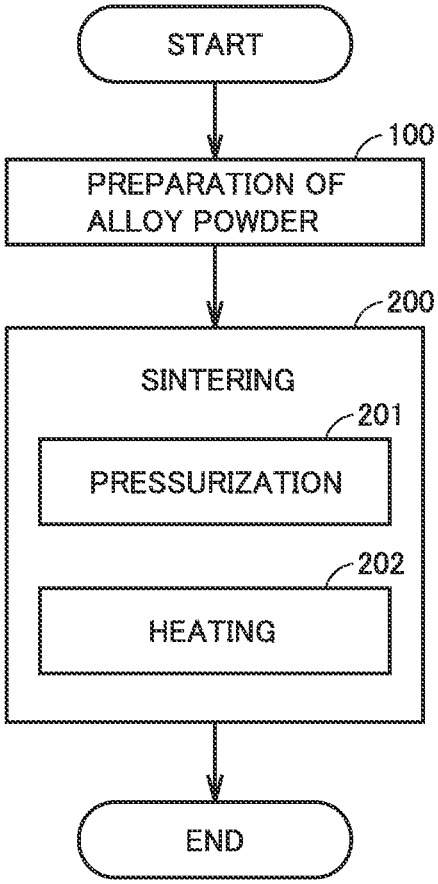
FIG. 2 is a flowchart schematically showing a method for producing a sintered material according to the present embodiment.

FIG. 2 is a flowchart schematically showing a method for producing a sintered material according to the present embodiment.

As shown in FIG. 2, the method for producing a sintered material includes the steps of: preparing an alloy powder (100); and sintering the alloy powder (200). The step of sintering the alloy powder (200) includes the steps of: pressurizing the alloy powder (201); and heating the alloy powder (202). That is, the method for producing a sintered material includes the steps of: preparing the alloy powder (100); pressurizing the alloy powder (201); and heating the alloy powder (202).

<<Preparation of Alloy Powder (100)>>

A method for producing a sintered material includes the step of preparing an alloy powder. For example, the alloy powder of the present embodiment can be prepared by the above-described method for producing an alloy powder.

<<Sintering (200)>>

A method for producing a sintered material includes the step of sintering an alloy powder. The step of sintering an alloy powder includes the steps of: pressurizing the alloy powder; and heating the alloy powder. That is, the method for producing a sintered material includes: the steps of: pressurizing the alloy powder; and heating the alloy powder.

For example, a green compact may be formed by pressurizing the alloy powder. The sintered material may be formed by heating the green compact.

The sintering method is not particularly limited. For example, spark plasma sintering (SPS), hot pressing, ultrahigh pressure pressing using a high temperature and high pressure generator, or the like can be carried out. The high temperature and high pressure generator may be of, for example, a belt type, a cubic type, or a split sphere type.

The alloy powder may be pressurized, for example, to greater than or equal to 10 MPa and less than or equal to 10 GPa, greater than or equal to 100 MPa and less than or equal to 10 GPa, greater than or equal to 1 GPa and less than or equal to 10 GPa, or greater than or equal to 5 GPa and less than or equal to 10 GPa. The alloy powder may be heated to, for example, higher than or equal to 900° C. and lower than or equal to 1700° C., higher than or equal to 1250° C. and lower than or equal to 1700° C., or higher than or equal to 1400° C. and lower than or equal to 1600° C.

Pressurization may be carried out simultaneously with heating. For example, in the method for producing a sintered material, the alloy powder may be heated to higher than or equal to 900° C. and lower than or equal to 1700° C. while being pressurized to greater than or equal to 10 MPa and less than or equal to 10 GPa. By heating the alloy powder under high pressure, the coarsening of alumina tends to be suppressed. Thus, fine alumina may be precipitated. That is, dispersion strengthening is expected to be improved.

EXAMPLES

Examples will be described below. However, the following examples do not limit the scope of claims.

<Production of Alloy Powder>

Various alloy powders were produced as follows.

<<Powder Nos. 1 to 41>>

Molten alloys containing elements at ratios shown in Tables 1 and 2 below were produced. The molten alloy was produced by a high frequency atmospheric melting furnace. The maximum temperature during producing was 3000° C.

The molten alloy was powdered by a water atomizing method. Thus, an alloy powder was prepared. The d50 of the alloy powder was adjusted by water pressure during water atomization. The alloy composition and d50 were measured by the method described above. For the measurement of the oxygen content, an oxygen/nitrogen analyzer "EMGA-920" manufactured by HORIBA, Ltd. was used. The measurement results are shown in the columns of "composition" and "water atomization" in Table 1 below.

As shown in Tables 1 and 2 below, in the powder Nos. 13 to 17 and 24 to 38, the alloy powder was produced so that the balance excluding W, Al, and oxygen further contained a transition metal (Cr, Ta, Mo, V, Ti, Zr, Hf, Nb, Mn, Re, Fe, Rh, Ir, Pd, or Pt), Si, Ge, B, C, or Sn in addition to at least one of Co and Ni. The contents of these elements are shown in the "other" columns of Tables 1 and 2 below.

As shown in Table 1 below, the powder Nos. 18 to 20 were milled after water atomization. The powder No. 18 was milled by a dry type jet mill. As the dry type jet mill, a dry type jet mill (model "NJ-100") manufactured by Sunrex Industry Co., Ltd. was used. Air was used as a milling gas. That is, the alloy powder was milled in the atmosphere. The pressure of the milling gas was 1.5 MPa. In Table 1 below, the dry type jet mill is abbreviated as "dry type JM".

The powder No. 19 was milled by a wet type jet mill. As the wet type jet mill, "G-smasher, PM-L1000" manufactured by Rix Corporation was used. In Table 1 below, the wet type jet mill is abbreviated as "wet type JM".

The powder No. 20 was milled by a wet type ball mill. Ethanol was used as a solvent. The amount of the solvent was set so that the solid content concentration of a slurry was 30% by mass. Cemented carbide balls (diameter: 3 mm) were used for media.

In the powder No. 21, the aging of the alloy powder was promoted before the alloy powder was milled. That is, the alloy powder was heated in a vacuum at 900° C. for 20 hours. After heating, the alloy powder was milled by a wet type ball mill. The condition of the wet type ball mill is the same as that of the powder No. 20.

Before and after milling, the d50 was measured. The measurement results are shown in the columns of "water atomization" and "milling" in Table 1 below. The d50 of the milled powder No. 21 in which the aging of the alloy powder was promoted before milling was slightly smaller than that of the powder No. 20 in which the aging was not promoted.

The powder No. 12 was heated in a low oxygen partial pressure nitrogen gas atmosphere after water atomization. That is, oxygen contained in the alloy powder was decreased. Heating was carried out in a carbon furnace. A low oxygen partial pressure nitrogen gas was formed by controlling an oxygen partial pressure in a nitrogen gas with an oxygen partial pressure controller. The oxygen partial pressure in the atmosphere was measured by a zirconia type oxygen concentration meter ("EMGA-650W" manufactured by HORIBA, Ltd.). At room temperature, the oxygen partial pressure was $1\times10^{-29}$ atm. The alloy powder was heated at 1300° C. for 2 hours.

TABLE 1

Sample list Part 1

| | Method for producing alloy powder | | | | | | | | Alloy powder Composition | | | | | |
|---|---|---|---|---|---|---|---|---|---|---|---|---|---|---|
| | Water atomization | | Milling | | Heating | | | | | | | | | |
| | Water | | | | | | | | Co | Ni | Al | W | | O |
| Powder No. | pressure MPa | d50 μm | Method — | d50 μm | Atmosphere — | Temperature ° C. | Time h | Implementation timing | % by mass | % by mass | % by mass | % by mass | Other % by mass | % by mass |
| 1 | 50 | 15 | Not milled | — | — | — | — | — | 36.97 | 35.97 | 9.99 | 16.99 | — | 0.08 |
| 2 | 55 | 10 | Not milled | — | — | — | — | — | 36.93 | 35.93 | 9.98 | 16.97 | — | 0.2 |
| 3 | 60 | 4 | Not milled | — | — | — | — | — | 35.89 | 34.92 | 9.70 | 16.49 | — | 3 |
| 4 | 65 | 1 | Not milled | — | — | — | — | — | 35.15 | 34.20 | 9.50 | 16.15 | — | 5 |
| 5 | 65 | 1 | Not milled | — | — | — | — | — | 35.00 | 35.00 | 5.00 | 20.00 | — | 5 |
| 6 | 65 | 1 | Not milled | — | — | — | — | — | 40.00 | 40.00 | 10.00 | 5.00 | — | 5 |
| 7 | 80 | 0.5 | Not milled | — | | | | — | 34.41 | 33.48 | 9.30 | 15.81 | — | 7 |
| 8 | 85 | 0.3 | Not milled | — | — | — | — | — | 33.30 | 32.40 | 9.00 | 15.30 | — | 10 |
| 9 | 90 | 0.1 | Not milled | — | — | — | — | — | 31.45 | 30.60 | 8.50 | 14.45 | — | 15 |
| 10 | 100 | 0.05 | Not milled | — | — | — | — | — | 29.60 | 28.80 | 8.00 | 13.60 | — | 20 |
| 11 | 80 | 0.5 | Not milled | — | — | — | — | — | 34.78 | 33.84 | 9.40 | 15.98 | — | 6 |
| 12 | 80 | 0.5 | Not milled | — | $N_2$ | 1300 | 2 | After water atomization | 36.63 | 35.64 | 9.90 | 16.83 | — | 1 |
| 13 | 65 | 1 | Not milled | — | — | — | — | — | 19.18 | 44.65 | 3.38 | 15.13 | 11.66(Cr) | 6 |
| 14 | 65 | 1 | Not milled | — | — | — | — | — | 19.18 | 44.65 | 3.38 | 15.13 | 11.66(Ta) | 6 |
| 15 | 65 | 1 | Not milled | — | — | — | — | — | 19.18 | 44.65 | 3.38 | 15.13 | 11.66(Mo) | 6 |
| 16 | 65 | 1 | Not milled | — | — | — | — | — | 19.18 | 44.65 | 3.38 | 15.13 | 11.66(V) | 6 |
| 17 | 65 | 1 | Not milled | — | — | — | — | — | 19.18 | 44.65 | 3.38 | 15.13 | 11.66(Ti) | 6 |
| 18 | 60 | 4 | Dry type JM | 1 | — | — | — | — | 34.04 | 33.12 | 9.20 | 15.64 | — | 8 |
| 19 | 60 | 4 | Wet type JM | 1 | — | — | — | — | 34.78 | 33.84 | 9.40 | 15.98 | — | 6 |
| 20 | 60 | 4 | Wet type BM | 1 | — | — | — | — | 34.78 | 33.84 | 9.40 | 15.98 | — | 6 |
| 21 | 60 | 4 | Wet type BM | 0.9 | Vacuum | 900 | 20 | Before milling | 34.78 | 33.84 | 9.40 | 15.98 | — | 6 |
| 22 | 65 | 1 | Not milled | — | — | — | — | — | 25.14 | 24.46 | 9.40 | 35.00 | — | 6 |
| 23 | 65 | 1 | Not milled | — | — | — | — | — | 25.14 | 24.46 | 35.00 | 9.40 | — | 6 |

TABLE 2

Sample list Part 2

| | Method for producing alloy powder | | | | | | | | Alloy powder Composition | | | | | |
|---|---|---|---|---|---|---|---|---|---|---|---|---|---|---|
| | Water atomization | | | | | | | | | | | | | |
| | Water | | Milling | | Heating | | | | Co | Ni | Al | W | | O |
| Powder No. | pressure MPa | d50 μm | Method — | d50 μm | Atmosphere — | Temperature ° C. | Time h | Implementation timing | % by mass | % by mass | % by mass | % by mass | Other % by mass | % by mass |
| 24 | 65 | 1 | Not milled | — | — | — | — | — | 19.18 | 44.65 | 3.38 | 15.13 | 11.66(Zr) | 6 |
| 25 | 65 | 1 | Not milled | — | — | — | — | — | 19.18 | 44.65 | 3.38 | 15.13 | 11.66(Hf) | 6 |
| 26 | 65 | 1 | Not milled | — | — | — | — | — | 19.18 | 44.65 | 3.38 | 15.13 | 11.66(Nb) | 6 |
| 27 | 65 | 1 | Not milled | — | — | — | — | — | 19.18 | 44.65 | 3.38 | 15.13 | 11.66(Mn) | 6 |
| 28 | 65 | 1 | Not milled | — | — | — | — | — | 19.18 | 44.65 | 3.38 | 15.13 | 11.66(Re) | 6 |
| 29 | 65 | 1 | Not milled | — | — | — | — | — | 19.18 | 44.65 | 3.38 | 15.13 | 11.66(Fe) | 6 |
| 30 | 65 | 1 | Not milled | — | — | — | — | — | 19.18 | 44.65 | 3.38 | 15.13 | 11.66(Rh) | 6 |
| 31 | 65 | 1 | Not milled | — | — | — | — | — | 19.18 | 44.65 | 3.38 | 15.13 | 11.66(Ir) | 6 |
| 32 | 65 | 1 | Not milled | — | — | — | — | — | 19.18 | 44.65 | 3.38 | 15.13 | 11.66(Pd) | 6 |
| 33 | 65 | 1 | Not milled | — | — | — | — | — | 19.18 | 44.65 | 3.38 | 15.13 | 11.66(Pt) | 6 |
| 34 | 65 | 1 | Not milled | — | — | — | — | — | 19.18 | 44.65 | 3.38 | 15.13 | 11.66(Si) | 6 |
| 35 | 65 | 1 | Not milled | — | — | — | — | — | 19.18 | 44.65 | 3.38 | 15.13 | 11.66(Ge) | 6 |
| 36 | 65 | 1 | Not milled | — | — | — | — | — | 19.18 | 44.65 | 3.38 | 15.13 | 11.66(B) | 6 |
| 37 | 65 | 1 | Not milled | — | — | — | — | — | 19.18 | 44.65 | 3.38 | 15.13 | 11.66(C) | 6 |
| 38 | 65 | 1 | Not milled | — | — | — | — | — | 19.18 | 44.65 | 3.38 | 15.13 | 11.66(Sn) | 6 |
| 39 | 65 | 1 | Not milled | — | — | — | — | — | 69.35 | 0 | 9.50 | 16.15 | — | 5 |
| 40 | 65 | 1 | Not milled | — | — | — | — | — | 0 | 69.35 | 9.50 | 16.15 | — | 5 |
| 41 | 65 | 1 | Not milled | — | — | — | — | — | 0 | 0 | 35.00 | 60.00 | — | 5 |

<<Powder Nos. 42 to 44>>

According to the same procedure as above, alloy powders shown in Table 3 below were prepared by a water atomizing method. The powder Nos. 43 and 44 were heated in a vacuum after water atomization. That is, the alloy powder was heated to 900° C. in a vacuum of $1\times10^{-3}$ Pa. The heating time is shown in Table 3 below.

Thus, alumina was precipitated in the alloy powder.

The oxygen content of the alloy powder was measured by an oxygen/nitrogen analyzer "EMGA-920" manufactured by HORIBA, Ltd. By XRD analysis and Rietveld analysis, the proportion of adsorbed oxygen and the proportion of oxygen forming alumina in the oxygen content were measured. For the measurement, an XRD apparatus "MiniFlex 600" manufactured by Rigaku Corporation was used. For the Rietveld analysis, integrated powder X-ray analysis software "PDXL" was used. The measurement results are shown in the column of "Presence Form of Oxygen" in Table 3 below.

<Production of Sintered Material>

The powder Nos. 1 to 41 were used as raw materials, and sintered material Nos. 1 to 41 shown in Tables 4 and 5 below were produced. "Powder No." shown in the column of "Preparation" of Tables 4 and 5 below corresponds to "Powder No." in the above Tables 1 and 2.

The alloy powder was sintered under the conditions shown in Tables 4 and 5 below. Pressurization was carried out simultaneously with heating. That is, the alloy powder was heated to 1500° C. while being pressurized to 7 GPa. Sintering was carried out for 15 minutes.

<Evaluation of Sintered Material>

The Vickers hardness of the sintered material was measured. The Vickers hardness was measured at 25° C. and 600° C. That is, room temperature hardness and high temperature hardness were measured. For the measurement, a high temperature micro hardness tester "QM type" manufactured by Nikon Corporation was used. The Vickers

TABLE 3

Sample list Part 3

| | Method for producing alloy powder | | | | | | | | Alloy powder | | | | | | |
|---|---|---|---|---|---|---|---|---|---|---|---|---|---|---|---|
| | Water atomization | | | | Heating | | | | Composition | | | | | Presence form of oxygen | |
| | Water | | Milling | | | Tem- | | Im- | Co | Ni | Al | W | O | Adsorbed | Alumina |
| Powder No. | pressure MPa | d50 μm | Method — | d50 μm | Atmosphere — | perature ° C. | Time h | plementation timing | % by mass | % by mass | % by mass | % by mass | % by mass | oxygen % by mass | % by mass |
| 42 | 65 | 1 | Not milled | — | — | — | — | — | 34.78 | 33.84 | 9.4 | 15.98 | 6 | 100 | 0 |
| 43 | 65 | 1 | Not milled | — | Vacuum | 900 | 1 | After water atomization | 34.78 | 33.84 | 9.4 | 15.98 | 6 | 48 | 52 |
| 44 | 65 | 1 | Not milled | — | Vacuum | 900 | 3 | After water atomization | 34.78 | 33.84 | 9.4 | 15.98 | 6 | 0 | 100 |

hardness was measured under the following conditions. The measurement results are shown in Table 4 below.

(Measurement Conditions of Vickers Hardness)

Heating rate: 20 K/min

Retention time: 5 min

Test load: 50 gf

Time under load: 30 sec

Atmosphere: $3\times10^{-5}$ torr

The deflective strength of the sintered material was measured. The deflective strength was measured under the conditions according to "JIS K 7017". The measurement results are shown in Table 5 below.

TABLE 4

Evaluation Result List Part 1

| Sintered material No. | Method for producing sintered material: Preparation Powder No. | Sintering Pressure GPa | Sintering Temperature ° C. | Sintering Time min | Sintered material Vickers hardness 25° C. — | Sintered material Vickers hardness 600° C. — |
|---|---|---|---|---|---|---|
| 1 | 1 | 7 | 1500 | 15 | 350 | 98 |
| 2 | 2 | 7 | 1500 | 15 | 450 | 231 |
| 3 | 3 | 7 | 1500 | 15 | 576 | 312 |
| 4 | 4 | 7 | 1500 | 15 | 612 | 356 |
| 5 | 5 | 7 | 1500 | 15 | 610 | 352 |
| 6 | 6 | 7 | 1500 | 15 | 615 | 360 |
| 7 | 7 | 7 | 1500 | 15 | 630 | 372 |
| 8 | 8 | 7 | 1500 | 15 | 556 | 305 |
| 9 | 9 | 7 | 1500 | 15 | 543 | 292 |
| 10 | 10 | 7 | 1500 | 15 | 342 | 125 |
| 11 | 11 | 7 | 1500 | 15 | 610 | 357 |
| 12 | 12 | 7 | 1500 | 15 | 585 | 330 |
| 13 | 18 | 7 | 1500 | 15 | 620 | 365 |
| 14 | 19 | 7 | 1500 | 15 | 615 | 360 |
| 15 | 20 | 7 | 1500 | 15 | 616 | 361 |
| 16 | 21 | 7 | 1500 | 15 | 617 | 362 |
| 17 | 22 | 7 | 1500 | 15 | 280 | 95 |
| 18 | 23 | 7 | 1500 | 15 | 210 | 93 |
| 19 | 39 | 7 | 1500 | 15 | 304 | 134 |
| 20 | 40 | 7 | 1500 | 15 | 311 | 139 |
| 21 | 41 | 7 | 1500 | 15 | 190 | 80 |

TABLE 5

Evaluation Result List Part 2

| Sintered material No. | Method for producing sintered material: Preparation Powder No. | Sintering pressure GPa | Sintering Temperature ° C. | Sintering Time min | Sintered material Deflective strength GPa |
|---|---|---|---|---|---|
| 4 | 4 | 7 | 1500 | 15 | 2.2 |
| 22 | 13 | 7 | 1500 | 15 | 2.4 |
| 23 | 14 | 7 | 1500 | 15 | 2.3 |
| 24 | 15 | 7 | 1500 | 15 | 2.2 |
| 25 | 16 | 7 | 1500 | 15 | 2.3 |
| 26 | 17 | 7 | 1500 | 15 | 2.2 |
| 27 | 24 | 7 | 1500 | 15 | 2.2 |
| 28 | 25 | 7 | 1500 | 15 | 2.2 |
| 29 | 26 | 7 | 1500 | 15 | 2.4 |
| 30 | 27 | 7 | 1500 | 15 | 2.2 |
| 31 | 28 | 7 | 1500 | 15 | 2.2 |
| 32 | 29 | 7 | 1500 | 15 | 2.3 |
| 33 | 30 | 7 | 1500 | 15 | 2.2 |
| 34 | 31 | 7 | 1500 | 15 | 2.5 |
| 35 | 32 | 7 | 1500 | 15 | 2.2 |
| 36 | 33 | 7 | 1500 | 15 | 2.2 |
| 37 | 34 | 7 | 1500 | 15 | 2.6 |
| 38 | 35 | 7 | 1500 | 15 | 2.2 |

TABLE 5-continued

Evaluation Result List Part 2

| Sintered material No. | Method for producing sintered material: Preparation Powder No. | Sintering pressure GPa | Sintering Temperature ° C. | Sintering Time min | Sintered material Deflective strength GPa |
|---|---|---|---|---|---|
| 39 | 36 | 7 | 1500 | 15 | 2.7 |
| 40 | 37 | 7 | 1500 | 15 | 2.5 |
| 41 | 38 | 7 | 1500 | 15 | 2.2 |

<Results>

As shown in the above Tables 1, 2 and 4, the sintered materials made of the alloy powders having the following compositions and d50 had improved high temperature hardness. This is considered to be because fine alumina is precipitated during sintering and the fine alumina causes dispersion strengthening. Among the sintered materials, sintered materials containing both Co and Ni as the balance had further improved room temperature hardness and high temperature hardness.

<<Composition>>

W: greater than or equal to 3% by mass and less than or equal to 30% by mass

Al: greater than or equal to 2% by mass and less than or equal to 30% by mass

Oxygen: greater than or equal to 0.2% by mass and less than or equal to 15% by mass The balance: at least one of Co and Ni <<Average Particle Diameter>> d50: greater than or equal to 0.1 μm and less than or equal to 10 μm

As shown in the above Table 3, the alloy powder sometimes contained alumina at the stage before sintering.

As shown in the above Tables 1, 2, and 5, when the balance of the alloy powder further contains at least one selected from the group consisting of transition metals (excluding W, Co, and Ni), Si, Ge, B, C, and Sn in addition to at least one of Co and Ni, the deflective strength of the sintered material can be expected to be improved.

The embodiments and Examples disclosed herein are illustrative in all respects, and are not restrictive. The technical scope defined by claims includes meanings equivalent to the claims and all changes within the scope.

REFERENCE SIGNS LIST

100: preparation of alloy powder, 101: preparation of powder, 102: aging, 103: contact with oxygen, 104: decrease of oxygen, 105: precipitation of alumina, 200: sintering, 201: pressurization, 202: heating

The invention claimed is:

1. An alloy powder comprising:

greater than or equal to 3% by mass and less than or equal to 30% by mass of tungsten;

greater than or equal to 2% by mass and less than or equal to 30% by mass of aluminum;

greater than or equal to 4% by mass and less than or equal to 10% by mass of oxygen; and at least one of cobalt and nickel as the balance, the alloy powder having an average particle diameter of greater than or equal to 0.3 μm and less than or equal to 2 μm.

2. The alloy powder according to claim 1, wherein the alloy powder comprises greater than or equal to 5% by mass and less than or equal to 8% by mass of the oxygen, and has an average particle diameter of greater than or equal to 0.5 μm and less than or equal to 1.5 μm.

3. The alloy powder according to claim 1, wherein the alloy powder comprises greater than or equal to 5% by mass and less than or equal to 25% by mass of the tungsten.

4. The alloy powder according to claim 1, wherein the alloy powder comprises greater than or equal to 5% by mass and less than or equal to 15% by mass of the aluminum.

5. The alloy powder according to claim 1, further comprising at least one selected from the group consisting of a transition metal (excluding the tungsten, the cobalt, and the nickel), silicon, germanium, boron, carbon, and tin.

6. The alloy powder according to claim 1, wherein at least part of the oxygen is adsorbed to the alloy powder.

7. The alloy powder according to claim 1, wherein at least part of the oxygen and the aluminum form alumina.

8. An alloy powder comprising:

greater than or equal to 5% by mass and less than or equal to 25% by mass of tungsten;

greater than or equal to 5% by mass and less than or equal to 15% by mass of aluminum;

greater than or equal to 5% by mass and less than or equal to 8% by mass of oxygen;

greater than or equal to 35% by mass and less than or equal to 45% by mass of nickel; and cobalt as the balance, the alloy powder having an average particle diameter of greater than or equal to 0.5 μm and less than or equal to 1.5 μm.

9. A sintered material comprising the alloy powder according to claim 1.

10. A method for producing a sintered material, the method comprising steps of:

preparing the alloy powder according to claim 1;

pressurizing the alloy powder; and heating the alloy powder.

11. The method for producing a sintered material according to claim 10, wherein the alloy powder is heated to higher than or equal to 900° C. and lower than or equal to 1700° C. while being pressurized to greater than or equal to 10 MPa and less than or equal to 10 GPa.

* * * * *